US005742880A

United States Patent [19]

Takenaka et al.

[11] Patent Number: 5,742,880

[45] Date of Patent: Apr. 21, 1998

[54] CHARGING MEMBER, AND PROCESS CARTRIDGE AND ELECTROPHOTOGRAPHIC APPARATUS HAVING THE CHARGING MEMBER

[75] Inventors: Masaaki Takenaka, Kashiwa; Takashi Yamashita, Nagareyama; Yoshihiro Hirai, Ibaraki-ken, all of Japan

[73] Assignees: Canon Kasei Kabushiki Kaisha, Ibaraki-ken; Canon Kabushiki Kaisha, Tokyo, both of Japan

[21] Appl. No.: 629,749

[22] Filed: Apr. 9, 1996

[30] Foreign Application Priority Data

Apr. 11, 1995 [JP] Japan ..... 7-085209

[51] Int. Cl.[6] ..... G03G 15/02

[52] U.S. Cl. ..... 399/176; 492/48; 492/54; 492/56

[58] Field of Search ..... 399/174, 176; 492/48, 54, 56; 361/220, 225

[56] References Cited

U.S. PATENT DOCUMENTS

| | | | |
|---|---|---|---|
| 4,198,739 | 4/1980 | Budinger et al. | 492/56 |
| 4,325,998 | 4/1982 | Chapman | 492/48 X |
| 4,967,231 | 10/1990 | Hosoya et al. | 399/176 |
| 5,608,500 | 3/1997 | Funabashi et al. | 399/176 |
| 5,625,858 | 4/1997 | Hirai et al. | 399/176 |

*Primary Examiner*—William J. Royer

*Attorney, Agent, or Firm*—Fitzpatrick, Cella, Harper & Scinto

[57] ABSTRACT

A charging member, which is to be provided in contact with an object member and to which a voltage is to be applied to electrostatically charge the object member, has a substrate, and a metal layer and a surface layer of a seamless tube. The charging member may be used with a process cartridge and an electrophotographic apparatus.

22 Claims, 2 Drawing Sheets

CHARGING MEMBER, AND PROCESS CARTRIDGE AND ELECTROPHOTOGRAPHIC APPARATUS HAVING THE CHARGING MEMBER

BACKGROUND OF THE INVENTION

1. Field of the Invention

This invention relates to a charging member which is provided in contact with an object member (a member to be charged) and to which a voltage is applied to electrostatically charge the object member.

This invention also relates to a process cartridge and an electrophotographic apparatus which have such a charging member.

2. Related Background Art

As a charging means used in image forming apparatus such as electrophotographic apparatus and electrostatic recording apparatus, the employment of a charging means of a contact charging system is put forward. The contact charging is a system in which a voltage is applied to a charging member provided in contact with an object member, to charge the object member to have a stated polarity and potential, and has the advantages that it can be performed at a lower power source voltage, may cause less corona discharge products such as ozone, and can achieve a lower cost because of simple construction.

The voltage may be applied to the charging member by a system where only a DC voltage is applied (a DC application system). Alternatively, it may be applied by a system where an oscillating electric field having a peak-to-peak voltage at least twice the voltage at which the object member begins to be charged when a DC voltage is applied to the contact charging member (an electric field whose value of voltage is periodically variable with time) is formed across the contact charging member and the object member to electrostatically charge the surface of the object member (an AC application system). The latter enables more uniform charging, and is effective.

From the shape or form of the charging member brought into contact with the object member, contact charging assemblies are roughly grouped into a roller type charging assembly having as the charging member a roller-shaped member (a charging roller) (Japanese Patent Applications Laid-open No. 63-7380 and No. 56-91253), a blade type charging assembly having a blade-like member (a charging blade) (Japanese Patent Application Laid-open No. 64-24264 and No. 56-194349), and a brush type charging assembly having a brush-like member (a charging brush) (Japanese Patent Application Laid-open No. 64-24264).

The charging roller is rotatably retained by bearings, is brought into pressure contact with the object member at a stated pressure, and is follow-up rotated with the movement of the object member.

The charging roller usually has a multi-layer structure comprised of a mandrel provided at its center as a substrate, a conductive elastic layer provided around the mandrel in the shape of a roller, and a surface layer or the like further provided on its periphery.

Of the above layers, the mandrel is a rigid body for maintaining the shape of the roller and at the same time plays a role of a feed electrode layer.

The elastic layer is usually required to have a volume resistivity of $10^4$ to $10^9\Omega\cdot$cm and have the function to ensure uniform contact with the object member on account of its elastic deformation. Hence, it is usually formed using a vulcanized rubber having a flexibility of 70 degrees or less as JIS-A rubber hardness and endowed with a conductivity. Also, in such conventional charging rollers, there have been a foam type charging roller making use of a rubber foam (or a spongy rubber) as the elastic layer and a solid type charging roller making use of no rubber foam.

As for the surface layer, it has the functions to improve charging uniformity of the object member, to prevent a leak from being caused by pinholes or the like the surface of the object member may have, to prevent adhesion of toner particles or paper dust and also to prevent bleeding of softening agents such as oil and plasticizer used to decrease the hardness of the elastic layer. The surface layer usually has a volume resistivity of $10^5$ to $10^{13}\Omega$.cm, and has been formed by applying a conductive coating material or covering the surface with a seamless tube.

However, in the case of the foam type charging roller, it is difficult to make uniform the size of cells or the state of their distribution. In either case of the foam type or the solid type, it is difficult to make uniform the degree of vulcanization. For these reasons, a local non-uniformity of resistivity may occur in the elastic layer to cause faulty charging.

Moreover, in the case of the foam type charging roller, a skin layer formed on the surface of the elastic layer at the time of vulcanization has so poor a smoothness that it is necessary to remove the skin layer by polishing, where, because of the difficulty in uniforming cell diameters, large cells may be laid bare to the surface as a result of the polishing, resulting in occurrence of concavities in the surface layer formed by coating in the subsequent step. The use of such a charging roller having concavities in the surface layer causes faulty charging, making it impossible to obtain good images.

SUMMARY OF THE INVENTION

An object of the present invention is to provide a contact charging member that may hardly cause local non-uniformity in resistivity of the elastic layer or faulty charging caused by the convexities of the surface layer.

Another object of the present invention is to provide a process cartridge and an electrophotographic apparatus which have the above charging member.

The present invention provides a charging member which is to be provided in contact with an object member and to which a voltage is to be applied to electrostatically charge the object member;

said charging member comprising a substrate, and metal layer and a surface layer comprising a seamless tube which are formed on the substrate in this order.

The present invention also provides a process cartridge and an electrophotographic apparatus, having the above charging member.

BRIEF DESCRIPTION OF THE INVENTION

Figure 5:
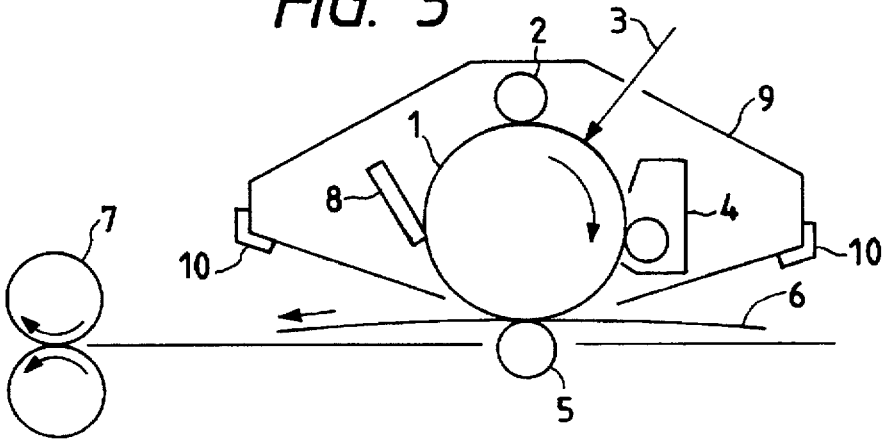

FIG. 5 schematically illustrates the construction of an electrophotographic apparatus provided with a process cartridge having the contact charging member of the present invention.

Figure 6:
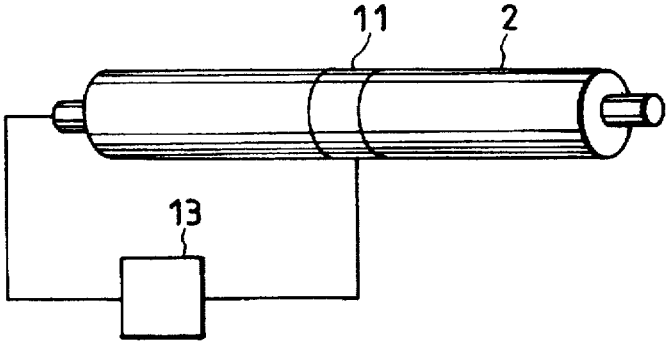

FIG. 6 illustrates how to measure a local resistivity of a charging roller.

DESCRIPTION OF THE PREFERRED EMBODIMENTS

The charging member of the present invention is provided in contact with an object member and a voltage is applied to the charging member to electrostatically charge the object member. It comprises a substrate, and a metal layer and a surface layer comprising a seamless tube which are formed on the substrate in this order.

The substrate in the present invention may also serve as a feed electrode layer, and there are no particular limitations on the shape and the material therefor. Usually, it is a mandrel of the roller. The substrate may be made of stainless steel, aluminum or an alloy thereof, copper or an alloy thereof, iron or an alloy thereof, as well as a highly rigid good conductor such as conductive engineering plastic, any of which may be used.

As the metal layer in the present invention, a good conductor as exemplified by aluminum, copper, iron, or an alloy of any of these, is preferably used. Hence, the charging member not only can prevent faulty charging from being caused by a local non-uniformity of resistivity of the elastic layer, which has been questioned in the prior art, but also can have a better surface uniformity than resin layers having a conductive material dispersed therein. From this point of view, the metal layer used in the present invention may preferably have a thickness of from 0.1 to 1.5 mm. In particular, the metal layer may preferably be formed of an aluminum pipe, which has a very good surface smoothness, can provide a satisfactory wall thickness uniformity, roundness and straightness and is available at a low cost.

Taking account of the contact performance and the charging noise in addition to the cost, the metal layer used in the present invention may preferably be a metal foil having a thickness of from 5 to 100 μm.

The surface layer used in the present invention will be described below. The surface layer in the present invention comprises a polymer previously formed into a film in the form of a seamless tube, which is externally fitted to the above metal layer in close contact when used.

Preferred polymers used in the seamless tube of the present invention may include rubbers such as silicone rubber, ethylene-propylene rubber, fluorine rubber, urethane rubber, epichlorohydrin rubber, acrylic rubber, natural rubber, isoprene rubber, butadiene rubber, 1,2-polybutadiene rubber, styrene-butadiene rubber, chloroprene rubber, nitrile rubber, butyl rubber, chlorosulfonated polyethylene, polysulfide rubber, and chlorinated polyethylene; thermoplastic elastomers of various types such as styrene type, olefin type, ester type, urethane type, isoprene type, 1,2-butadiene type, vinyl chloride type, amide type and ionomer type; polyolefins such as polyethylene, various ethylene type copolymers, polypropylene, a propylene/ethylene copolymer, and polybutene; polyamides such as nylon 6, nylon 66, nylon 11, nylon 12, and other copolymer nylons; saturated polyesters such as polyethylene terephthalate (PET), and polybutylene terephthalate (PBT); styrene resins such as polystyrene, high-impact polystyrene (HIPS), acrylonitrile-butadiene-styrene resin (ABS), acrylonitrile-ethylene/propylene rubber-styrene resin (AES), and acrylonitrile-acrylic rubber-styrene resin (AAS); and thermoplastic resins such as acrylic resin, vinyl chloride resin, vinylidene chloride resin, polycarbonate, polyacetal, polyphenylene oxide or a polystyrene modified product thereof, polyimide resin, polyallylate, and vinylidene fluoride homopolymers or copolymers.

Polymer alloys or polymer blends comprising two or more polymers selected from the foregoing rubbers, thermoplastic elastomers and thermoplastic resins may also be used.

The seamless tube of the present invention can be obtained using a conductive polymer composition comprised of the polymer having various types as described above, and a conductivity-providing agent as described below, optionally together with other additives, the composition being formed into a film in the form of a tube by extrusion, injection molding, blow molding or the like. Of these forming or molding methods, extrusion is particularly preferred.

As the conductivity-providing agent, any known materials may be used, as exemplified by fine carbon particles such as carbon black and graphite powder; fine particles of metals such as nickel, silver, aluminum and copper; fine particles of conductive metal oxides mainly composed of tin oxide, zinc oxide, titanium oxide, aluminum oxide or silica and doped with impurity ions having a different valence; conductive fibers such as carbon fiber; metallic fibers such as stainless steel fiber; conductive whiskers such as carbon whisker and conductive potassium titanate whisker obtained by subjecting the crystal surfaces of potassium titanate whisker to a conductive treatment; and conductive fine particles of polymers such as polyaniline and polypyrrole.

The seamless tube used in the present invention may be used in such a state that it has been merely formed by the above forming or molding method. For the purpose of achieving, e.g., better durability and environmental resistance, the seamless tube obtained by the above method may preferably be further cross-linked into a conductive cross-linked polymer. As methods for cross-linking the conductive polymer formed into a film in the form of a tube, it is effective to use chemical cross-linking in which a cross-linking agent such as sulfur, an organic peroxide or an amine is previously added in accordance with the type of the polymer to cause a cross-linkage at a high temperature, and radiation cross-linking in which radiations such as electron rays and gamma rays are applied to carry out cross-linking. Of these cross-linking methods, cross-linking with electron rays is particularly preferred in view of its advantages that there is no possibility for the cross-linking agent or a decomposition product thereof to transfer to the object member to cause contamination and also it is unnecessary to make high-temperature treatment, and also in view of its safety.

The surface layer used in the present invention may preferably have a resistivity of from $10^5$ to $10^{13}\Omega$.cm, and particularly preferably from $10^6$ to $10^{12}\Omega$.cm.

In the present invention, the use of the seamless tube as the surface layer makes it possible to achieve a very good uniformity in charging, because any irregularities more or less present on the metal layer may hardly appear as irregularities on the surface layer.

In the present invention, the use of the metal layer, which is a good conductor, also makes it possible to settle the non-uniformity in resistivity especially in the peripheral direction, which is a technical problem peculiar to tube layers, to thereby obtain a charging member having a very uniform resistivity.

The surface layer used in the present invention can be formed by various methods. Extrusion is preferred as described above. More specifically, the polymer composition and the conductivity-providing agent, optionally together with the cross-linking agent, a stabilizer and other additives, may be mixed to previously produce a compound, and the compound may be extruded from a die having a ring-like slit by means of an extruder, followed by cooling to continuously produce the seamless tube. During the cooling or after the cooling, the tube may be again heated so as to be expanded in diameter by using air pressure or the like means, whereby a heat-shrinkable tube is obtained. If it is not expanded, a non-heat-shrinkable tube is obtained.

The seamless tube used in the present invention may be either non-heat-shrinkable or heat-shrinkable. The manner of externally fitting it to the metal layer differs depending on whether it is non-heat-shrinkable or heat-shrinkable.

In the case when it is a non-heat-shrinkable tube, the tube must have an inner diameter not larger than the external diameter of the metal layer in order to ensure the close contact between the metal layer and the surface layer. A metal tube, or a roller member having the metal layer, may be inserted to the tube in such a state that it has been expanded in diameter by blowing compressed air into it and then the air pressure may be released, so that its external fitting is completed.

On the other hand, in the case of a heat-shrinkable tube, the tube may preferably have an inner diameter larger than the external diameter of the metal layer. After the metal tube or the roller member has been inserted, the tube may be made to undergo heat shrinkage so as to come into close contact with the metal layer by, e.g., heating it for a given time in a thermostatic chamber, so that its external fitting is completed.

In the present invention, the charging member may preferably have a support layer such as an elastic layer between the substrate and the metal layer.

In the prior art, it has been essential for the elastic layer to be a conductive elastic layer whose resistivity has been made uniformed at a certain level. However, the support layer in the present invention is a layer replaceable with the conductive elastic layer used in the prior art. It may be an insulating material, and is not necessarily required to be uniformly formed over the whole length of the charging assembly The support layer in the present invention may also be either an elastic body having a flexibility, or a hard body (or a rigid body with less flexibility) as exemplified by an insulating or conductive hard plastic. This is because, as previously stated, the main reason for the elastic layer to be used in the prior art is to ensure uniform contact with the object member, and, when in the present invention the aluminum pipe or the like having a satisfactory roundness and straightness is used as the metal layer, the uniform contact with the object member can be ensured even if the support layer is formed of a rigid body with less flexibility.

More specifically, the support layer may have only the function to support the metal layer so long as an electrically conducting means between the feed electrode and the metal layer is made ready in someway.

Needless to say, in the present invention, it is also possible to use the elastic body having together the two functions of elasticity and conductivity as used in the prior art.

In the present invention, as the electrically conducting means between the feed electrode and the metal layer, it is possible to use, for example, a spring or foil made of metal, a conductive polymer or a foam thereof, a conductive coating material or a conductive adhesive.

Specific embodiments of the present invention will be described below with reference to FIGS. 1 to 4. The present invention is by no means limited to these embodiments.

Figure 1:
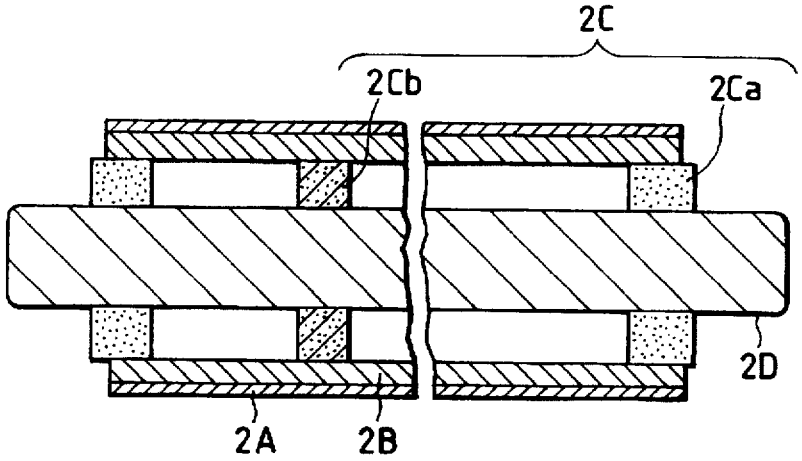
FIG. 1 is a diagrammatic vertical cross section of a contact charging member produced in Example 1.

In FIG. 1, reference numeral 2A denotes the surface layer, where the seamless tube is used. Reference numeral 2B denotes the metal pipe, and 2Ca, an insulating hard body. Reference numeral 2Cb denotes the electrically conducting means formed between 2D and the metal pipe 2B; 2D being the substrate, the mandrel, and being the feed electrode. As the conducting means, a conductive rubber foam is kept in mind, but a metal ring or the like may be used. Herein, reference numerals 2Ca and 2Cb are collectively referred to as a support layer 2C.

Figure 2:
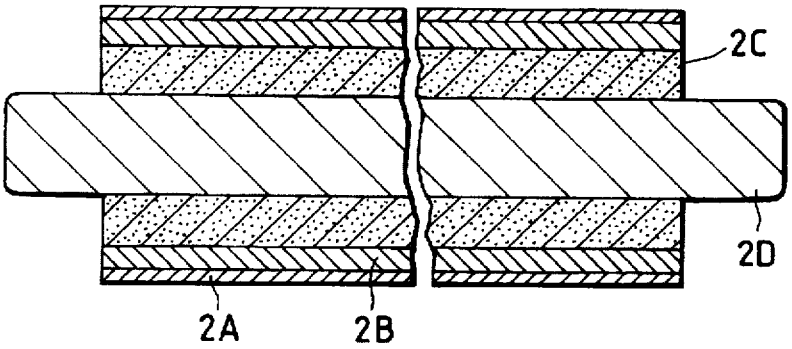
FIG. 2 is a diagrammatic vertical cross section of a contact charging member produced in Example 2.

In the embodiment shown in FIG. 2, the support layer 2C has an elasticity and a conductivity at the same time, where a conductive elastic body is used. In this instance, because of the presence of a metal layer 2B, there is no problem if the support layer 2C has a local non-uniformity in resistivity.

Figure 3:
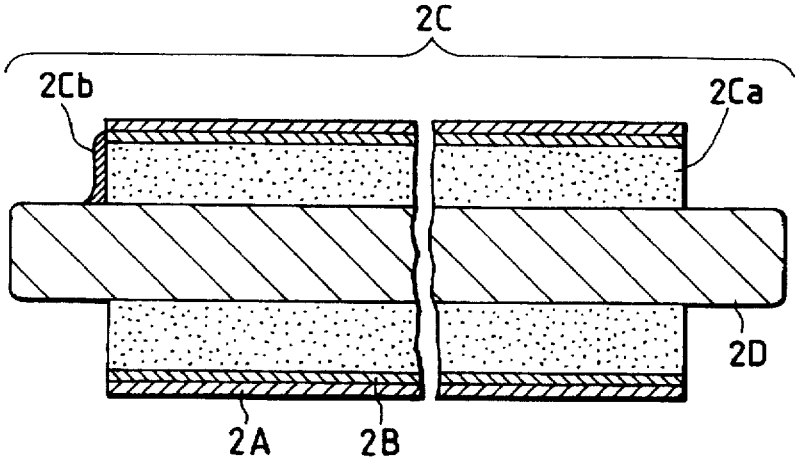
FIG. 3 is a diagrammatic vertical cross section of a contact charging member produced in Example 3.

In the embodiment shown in FIG. 3, metal foil is used as the metal layer 2B. Reference numeral 2Ca denotes an insulating elastic body, and 2Cb, a conductive coating material, which is the electrically conducting means formed between 2D and the metal layer 2B; 2D being the substrate, the mandrel, and being the feed electrode. Herein, reference numerals 2Ca and 2Cb are collectively referred to as a support layer 2C. The charging roller shown in FIG. 3 employs as the layer 2Ca an insulating rubber, and hence it is unnecessary to manage resistivity in its manufacture and general-purpose rubber tubes can be utilized. Thus, the production cost can be decreased. Moreover, any variations in resistivity which are attributable to environmental changes can be disregarded, and it becomes possible to produce charging rollers having a stable quality.

Figure 4:
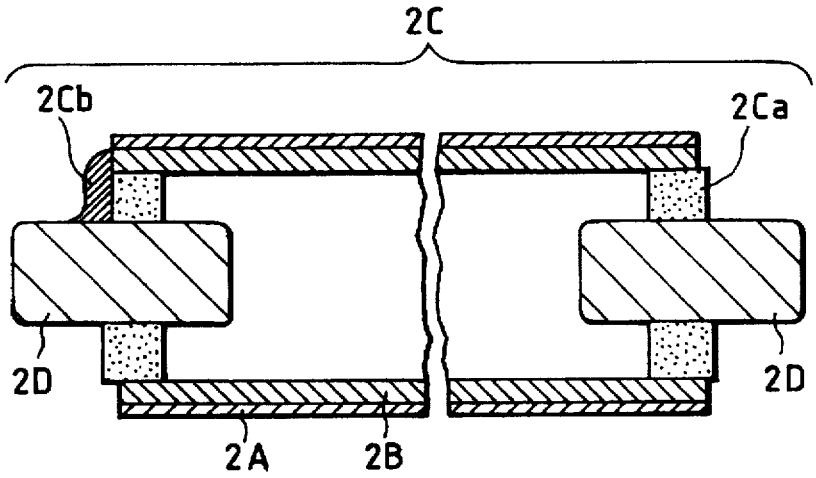
FIG. 4 is a diagrammatic vertical cross section of a contact charging member produced in Example 4.

In the embodiment shown in FIG. 4, the mandrel 2D is divided into two shorter ones so that they may be fixed only to both ends. Also, a conductive coating material 2Cb is used as the electrically conducting means. This embodiment enables easier assemblage than the embodiment shown in FIG. 1 to make it possible to reduce production cost.

FIG. 5 schematically illustrates the construction of an electrophotographic apparatus having a process cartridge having the charging member of the present invention.

In FIG. 5, reference numeral 1 denotes an electrophotographic photosensitive member, which is rotatingly driven in the direction of an arrow at a given peripheral speed. The photosensitive member 1 is uniformly charged on its periphery to a positive or negative, given potential through the charging member 2 of the present invention. The photosensitive member thus charged is then photoimagewise exposed to light 3 emitted from an imagewise exposure means (not shown) for slit exposure or laser beam scanning exposure. In this way, electrostatic latent images are successively formed on the periphery of the photosensitive member 1.

The electrostatic latent images thus formed are subsequently developed by toner by the operation of a developing means 4. The resulting toner-developed images are then successively transferred by the operation of a transfer means 5, to the surface of a transfer medium 6 fed from a paper feed section (not shown) to the part between the photosensitive member 1 and the transfer means 5 in the manner synchronized with the rotation of the photosensitive member 1.

The transfer medium 6 on which the images have been transferred is separated from the surface of the photosensitive member, is led through an image fixing means 7, where the images are fixed, and is then printed out of the apparatus as a copied material (a copy).

The surface of the photosensitive member 1 after the transfer of images is brought to removal of the toner remaining after the transfer, through a cleaning means 8.

Thus the photosensitive member is cleaned on its surface, and then repeatedly used for the formation of images.

In the present invention, the apparatus may be constituted of a combination of plural components integrally joined as a process cartridge from among the constituents such as the above electrophotographic photosensitive member 1, charging means 2, developing means 4 and cleaning means 8 so that the process cartridge is detachable from the body of the electrophotographic apparatus such as a copying machine or a laser beam printer. For example, the developing means 4 and the cleaning means 8 may be integrally supported in a cartridge together with the electrophotographic photosensitive member 1 and the charging member 2 to form a process cartridge 9 that is detachable from the body of the apparatus through a guide means such as a rail 10 provided in the body of the apparatus.

In the case when the electrophotographic apparatus is a copying machine or a printer, the light 4 of the imagewise exposure is light reflected from, or transmitted through, an original, or light irradiated by the scanning of a laser beam, the driving of an LED array or the driving of a liquid crystal shutter array according to signals obtained by reading an original and converting the information into signals.

The present invention will be described below in greater detail by giving Examples.

EXAMPLE 1

The present Example is concerned with the charging roller shown in FIG. 1.

A heat-shrinkable tube of 16.5 mm inner diameter and 250 μm wall thickness (SUMITUBE G3, trade name; available from Sumitomo Electric Industries, Ltd.) was put around an aluminum pipe of 12 mm outer diameter, 10 mm inner diameter and 225 mm long (available from Showa Aluminum Corporation), followed by heat-shrinking for 10 minutes in a thermostatic chamber having an atmosphere of 200° C. air, to form a surface layer coming in close contact with the aluminum pipe.

The above heat-shrinkable tube was a seamless tube obtained by forming conductive chlorinated polyethylene into a film by extrusion in the form of a tube, exposing the tube to electron rays to effect cross-linking, and then heating the resulting tube to soften to expand its diameter by using air pressure, followed by cooling to impart heat-shrinkable properties. The tube having been shrinked had a resistivity of $1\times10^{8}\Omega$.cm.

Next, a conductive urethane foam (EVERLIGHT EPT-51, trade name; available from BS Tokai Kasei Co., Ltd.) cut into a strip of 3 mm thick, 8 mm wide and 100 mm long was wound in a spiral around a mandrel of 6 mm diameter and 251 mm long at its lengthwise middle portion, and the both ends thereof were fixed to the mandrel by means of an adhesive tape so that an electrically conducting path was formed between the aluminum pipe and the mandrel. The conductive urethane foam had a resistivity of $1\times10^{5}\Omega$.cm.

The mandrel thus worked was inserted to the aluminum pipe on which the surface layer had been formed, and hard rings of 10 mm long, 10 mm outer diameter and 6 mm inner diameter, made of insulating nylon 6, were crammed into the pipe from the both ends of the mandrel. After an epoxy type adhesive was coated, the aluminum pipe and the mandrel were fixed in the disposition as shown in FIG. 1.

The local resistivity of the above charging roller was measured in the following way: As shown in FIG. 6, an aluminum foil 11 of 10 mm wide was wound on a charging roller 2 and a DC voltage of 250 V was applied across the mandrel and the aluminum foil from a power source 13 to measure the electric current flowing there, and the resistivity between the mandrel and the aluminum foil was calculated. Then, the position of the aluminum foil was changed, where any local variations in resistivity of the charging roller in its lengthwise direction were also measured. The local resistivity thus measured on the charging roller was $(5.0\pm0.05)\times10^{4}\Omega$, and was found to be very highly uniform.

Surface irregularities of the charging roller were also visually observed to find that there were seen no problematic irregularities.

Next, the charging roller was set in a process cartridge (EP-L, manufactured by Canon Inc.), and the process cartridge was installed to a laser beam printer (LASER SHOT A404, trade name; manufactured by Canon Inc.) to make visual evaluation of image quality of output images. As the result, there was nothing wrong even when images were outputted on 3,500 sheets in an environment of 25° C. and 50% RH.

EXAMPLE 2

The present Example is concerned with the charging roller shown in FIG. 2.

100 parts by weight (hereinafter simply "parts") of EPDM (EPT4045, available from Mitsui Chemical Corporation), 10 parts of zinc white No.1, 2 parts of stearic acid, 2 parts of an accelerator M, 1 part of an accelerator BZ, 2 parts of sulfur, 5 parts of a foaming agent (CELLMIC C, trade name; available from Sankyo kasei Co., Ltd.), 5 parts of a foaming aid (CELLTON NP, trade name; available from Sankyo kasei Co., Ltd.), 20 parts of FEF carbon, 70 parts of insulating oil and 8 parts of KETJENBLACK EC were mixed, and the mixture was uniformly dispersion kneaded by means of a twin roll to obtain a conductive rubber compound.

A primer was applied to a mandrel having the same shape as in Example 1, and the above rubber compound was wound around it. The mandrel with the rubber compound was put into a mold, followed by pre-foaming at 40° C. and 100 kg/cm$^2$ to form a 1 mm thick rubber compound layer on the mandrel. This was inserted to an aluminum pipe having the same shape as in Example 1, followed by heating by steam heating (160° C., 30 minutes) to carry out foaming and simultaneously effect vulcanization, to thereby bring the rubber layer into close contact with the aluminum pipe. Around the roller member thus obtained, the same heat-shrinkable tube as used in Example 1 was put, followed by heat-shrinking under the same conditions as in Example 1. Thus, the charging roller was completed.

The local resistivity of the above charging roller was measured in the same manner as in Example 1. As a result, it was $(5.2\pm0.03)\times10^{4}\Omega$, and was found to be very highly uniform. Also, surface irregularities of the charging roller were observed to find that there were seen no problematic irregularities.

The image quality of output images was also evaluated in the same manner as in Example 1, to find that there was nothing wrong even when images were outputted on 3,500 sheets.

EXAMPLE 3

The present Example is concerned with the charging roller shown in FIG. 3.

A commercially available rubber tube of 6 mm inner diameter and 12 mm outer diameter was cut in a length of 225 mm, and the same mandrel as used in Example 1 was inserted thereto to obtain a rubber roller. Next, aluminum foil of 20 μm thick was uniformly wound around the whole rubber portion, and a synthetic rubber type conductive adhesive (3315, available from Three Bond Co., Ltd.) was coated at its one end to form an electrically conducting path between the aluminum foil and the mandrel.

Around the roller member thus obtained, the same heat-shrinkable tube as used in Example 1 was put, followed by heat-shrinking under the same conditions as in Example 1.

The local resistivity of the charging roller thus obtained was measured in the same manner as in Example 1. As a result, it was $(5.8\pm0.06)\times10^4\Omega$, and was found to be very highly uniform. Also, surface irregularities of the charging roller were observed to find that there were seen no problematic irregularities.

The image quality of output images was also evaluated in the same manner as in Example 1, to find that there was nothing wrong even when images were outputted on 3,500 sheets.

EXAMPLE 4

The present Example is concerned with the charging roller shown in FIG. 4.

A charging roller was completed in the same manner as in Example 1 except that mandrels of 50 mm long each were fitted to the both ends, the roller was 251 mm in whole length, and the conductive adhesive as used in Example 3 was coated on one end to form the conducting path.

Variations of the local resistivity, surface irregularities, and image quality of output images were examined to make evaluation in the same manner as in Example 1, and like results were obtained.

EXAMPLE 5

A charging roller was produced in the same manner as in Example 3 except that the aluminum pipe foil was replaced with iron foil of 20 μm thick, and evaluation was made similarly. The results of measurement of resistivity and evaluation of image quality were like those of Example 3.

EXAMPLE 6

A charging roller was produced in the same manner as in Example 3 except that the aluminum pipe foil was replaced with stainless steel foil of 20 μm thick, and evaluation was made similarly. The results of measurement of resistivity and evaluation of image quality were like those of Example 3.

Comparative Example 1

A roller member was produced in the same manner as in Example 1 except that the heat-shrinkable tube (SUMITUBE G3, trade name; available from Sumitomo Electric Industries, Ltd.) was not put around the substrate. The roller member is the same as the one shown in FIG. 1 except that the surface layer 2A was absent.

Next, a dispersion composed of 75 g of methoxymethylated nylon (TORESIN EF30T, trade name; available from Teikoku Chemical Industry Co., Ltd.), 315 g of methanol, 110 g of toluene, 1.5 g of citric acid and 1.5 g of carbon black (KETJENBLACK EC) was prepared, and the above roller member was immersed therein, followed by drying at 70° C. for 15 minutes. This procedure was repeated twice to form a surface layer 2A. Thus, a charging roller was made up. The surface layer 2A was 30 μm thick.

The local variations in resistivity were measured in the same manner as in Example 1. As a result, it was $(4.3\pm0.05)\times10^4\Omega$, and was found to be like that of Example 1. Like results were also obtained in respect of the visual observation of surface irregularities.

Image quality was further evaluated in the same manner as in Example 1. As a result, it was found wrong after images were outputted on 2,000 sheets. Then the cartridge was disassembled and the roller was detached to make observations. As a result, it was found that the toner had adhered to the roller surface in a non-uniform state, and the roller did not come into contact with the photosensitive member at some portions, to which the toner had thickly adhered, causing faulty images. This was presumed to have been caused by the surface layer formed in this Comparative Example, which was too thin and also too hard to provide a sufficient nip width.

Comparative Example 2

From a roller member obtained in the same manner as in Example 2, its aluminum pipe was removed to obtain a roller member comprised of only the mandrel and the rubber layer.

Around the roller member thus obtained, the same heat-shrinkable tube as used in Example 1 was put, followed by heat-shrinking under the same conditions as in Example 1. Thus, a charging roller was completed.

The local resistivity of the charging roller was measured in the same manner as in Example 1. As a result, it was $(25.5\pm11.2)\times10^4\Omega$, and was found to be greatly varied. With regard to the surface irregularities of the charging roller, there were seen no problematic irregularities.

Image quality of output images was further evaluated in the same manner as in Example 1. As a result, it was found unacceptable after images were outputted on 2,500 sheets. Its state was examined in detail. As a result, it was made clear that fog occurred correspondingly to high-resistivity portions of the roller.

What is claimed is:

1. A charging member which is to be provided in contact with an object member and to which a voltage is to be applied to electrostatically charge the object member;

said charging member comprising a substrate, and a metal layer and a surface layer comprising a seamless tube which are formed on the substrate in this order.

2. The charging member according to claim 1, wherein said charging member has a support layer between the substrate and the metal layer.

3. The charging member according to claim 1 or 2, wherein said metal layer is formed of a metal pipe.

4. The charging member according to claim 3, wherein said metal pipe is an aluminum pipe.

5. The charging member according to claim 1 or 2, wherein said metal layer is formed of a metal foil.

6. The charging member according to claim 5, wherein said metal foil is an aluminum foil.

7. The charging member according to claim 1 or 2, wherein said charging member has the shape of a roller.

8. The charging member according to claim 1 or 2, wherein said object member is an electrophotographic photosensitive member.

9. A process cartridge comprising an electrophotographic photosensitive member and a charging member, or the electrophotographic photosensitive member, the charging member and a developing means or a cleaning means;

said charging member being provided in contact with the electrophotographic photosensitive member and to which a voltage is applied to electrostatically charge the electrophotographic photosensitive member, and comprising a substrate, and a metal layer and a surface layer comprising a seamless tube which are formed on the substrate in this order;

said electrophotographic photosensitive member and said charging member, or said electrophotographic photosensitive member, said charging member and said developing means or said cleaning means, being integrally supported in and detachable from the body of an electrophotographic apparatus.

10. The process cartridge according to claim 9, wherein said charging member has a support layer between the substrate and the metal layer.

11. The process cartridge according to claim 9 or 10, wherein said metal layer is formed of a metal pipe.

12. The process cartridge according to claim 11, wherein said metal pipe is an aluminum pipe.

13. The process cartridge according to claim 9 or 10, wherein said metal layer is formed of a metal foil.

14. The process cartridge according to claim 13, wherein said metal foil is an aluminum foil.

15. The process cartridge according to claim 9 or 10, wherein said charging member has the shape of a roller.

16. An electrophotographic apparatus comprising an electrophotographic photosensitive member, a charging member, an exposure means, a developing means and a transfer means;

said charging member being provided in contact with the electrophotographic photosensitive member and to which a voltage is applied to electrostatically charge the electrophotographic photosensitive member, and comprising a substrate, and a metal layer and a surface layer comprising a seamless tube which are formed on the substrate in this order.

17. The electrophotographic apparatus according to claim 16, wherein said charging member has a support layer between the substrate and the metal layer.

18. The electrophotographic apparatus according to claim 16 or 17, wherein said metal layer is formed of a metal pipe.

19. The electrophotographic apparatus according to claim 18, wherein said metal pipe is an aluminum pipe.

20. The electrophotographic apparatus according to claim 16 or 17, wherein said metal layer is formed of a metal foil.

21. The electrophotographic apparatus according to claim 20, wherein said metal foil is an aluminum foil.

22. The electrophotographic apparatus according to claim 16 or 17, wherein said charging member has the shape of a roller.

* * * * *